US008967361B2

(12) United States Patent
Martin

(10) Patent No.: US 8,967,361 B2
(45) Date of Patent: Mar. 3, 2015

(54) COIN COUNTING AND SORTING MACHINES

(71) Applicant: Coinstar, Inc., Bellevue, WA (US)

(72) Inventor: Douglas A. Martin, Woodinville, WA (US)

(73) Assignee: Outerwall Inc., Bellevue, WA (US)

( * ) Notice: Subject to any disclaimer, the term of this patent is extended or adjusted under 35 U.S.C. 154(b) by 0 days.

(21) Appl. No.: 13/778,461

(22) Filed: Feb. 27, 2013

(65) Prior Publication Data

US 2014/0238816 A1 Aug. 28, 2014

(51) Int. Cl.

| | |
|---|---|
| ***G06M 7/00*** | (2006.01) |
| ***G07D 3/14*** | (2006.01) |
| ***G07D 3/16*** | (2006.01) |
| ***G07D 9/00*** | (2006.01) |
| ***G07D 3/06*** | (2006.01) |

(52) U.S. Cl.

CPC .. *G07D 3/16* (2013.01); *G07D 3/06* (2013.01); *G07D 9/008* (2013.01)

USPC ..... 194/215; 194/342

(58) Field of Classification Search

USPC ..... 194/215, 216, 217, 342; 453/13, 49, 57, 453/58, 3, 4, 9, 12, 15, 1, 2, 33–36

See application file for complete search history.

(56) References Cited

U.S. PATENT DOCUMENTS

| | | | |
|---|---|---|---|
| 269,461 | A | 12/1882 | Rakestraw |
| 383,166 | A | 5/1888 | Bailey |
| 446,303 | A | 2/1891 | Thompson |
| 545,185 | A | 8/1895 | Yost |
| 1,010,993 | A | 12/1911 | White |
| 1,234,707 | A | 7/1917 | Whistler |
| 1,345,858 | A | 7/1920 | Jenkins |
| 1,473,745 | A | 11/1923 | Stedman |
| 1,512,447 | A | 10/1924 | Birdsall |
| 1,585,242 | A | 5/1926 | Hageman |
| 1,668,626 | A | 5/1928 | Brandt |
| 1,711,049 | A | 4/1929 | Fonda et al. |
| 1,813,296 | A | 7/1931 | Kidwell |

(Continued)

FOREIGN PATENT DOCUMENTS

| | | |
|---|---|---|
| AU | 695403 | 8/1998 |
| AU | 714452 | 1/2000 |

(Continued)

OTHER PUBLICATIONS

"The Electrical Engineering Handbook", 2nd Ed. Published by CRC Press and IEEE in 1997, Edited by Richard C. Dorf, pp. 23-31.

(Continued)

*Primary Examiner* — Mark Beauchaine

(74) *Attorney, Agent, or Firm* — Perkins Coie LLP

(57) ABSTRACT

Systems, apparatuses, and associated methods for counting and sorting coins are described herein. In one embodiment, a coin processing machine can include a coin input region, a coin counting portion, and a coin sorting portion. The coin counting portion can include a first hopper that receives coins from the coin input region, and a coin discriminator that receives the coins from the first hopper and discriminates the coins to determine their value. The coin sorting portion can include a second coin hopper that receives the coins from the coin discriminator, and a coin sorter that receives the coins from the second hopper and sorts the coins into individual denominations.

20 Claims, 5 Drawing Sheets

(56) References Cited

U.S. PATENT DOCUMENTS 1,847,940 A 3/1932 Giles
1,934,839 A 11/1933 Otto at al.
1,945,948 A 2/1934 Morin
2,014,505 A 9/1935 Patche
2,119,676 A 6/1938 Heller
2,163,351 A 6/1939 Josey
2,317,351 A 4/1943 Andalikiewicz et al.
2,336,606 A 12/1943 Clarence
2,398,955 A 4/1946 O'toole
2,461,314 A 2/1949 Davis et al.
2,519,357 A 8/1950 Dougherty
2,569,360 A 9/1951 Weingart
2,621,665 A 12/1952 McGee
2,644,470 A 7/1953 Labbe
2,646,805 A 7/1953 Anderson
2,856,561 A 10/1958 Giezendanner
2,865,561 A 12/1958 Rosapepe
2,869,723 A 1/1959 Autio
2,881,774 A 4/1959 Labbe
2,931,480 A 4/1960 Heim
2,960,377 A 11/1960 Simjian
2,964,181 A 12/1960 Demarest at al.
3,007,576 A 11/1961 Hannaford
3,009,555 A 11/1961 Seckula, Sr.
3,048,251 A 8/1962 Bower
3,056,132 A 9/1962 Simjian
3,065,467 A 11/1962 Prevost
3,121,435 A 2/1964 White
3,132,654 A 5/1964 Adams
3,143,118 A * 8/1964 Haines ..... 453/13
3,147,839 A 9/1964 White, Jr.
3,173,742 A 3/1965 Simjian
3,196,257 A 7/1965 Buchholtz et al.
3,196,887 A 7/1965 White, Jr.
3,286,805 A 11/1966 New
3,292,818 A 12/1966 Jaworski
3,297,242 A 1/1967 Karp
3,351,075 A 11/1967 Ernst
3,361,141 A 1/1968 Reis
3,381,694 A 5/1968 Lempke
3,396,737 A 8/1968 Picollo
3,415,348 A 12/1968 Wahlberg
3,463,171 A 8/1969 Dolman
3,599,771 A 8/1971 Hinterstocker et al.
3,603,327 A 9/1971 Buchholz et al.
3,680,566 A 8/1972 Tanaka et al.
3,695,448 A 10/1972 Johansson et al.
3,752,168 A 8/1973 Bayha
3,763,871 A 10/1973 Jobst et al.
3,788,440 A 1/1974 Propice et al.
3,791,574 A 2/1974 Picquot et al.
3,797,307 A 3/1974 Johnston
3,804,249 A 4/1974 Gibbons et al.
3,815,717 A 6/1974 Arseneau
3,941,226 A 3/1976 Drakes
3,960,293 A 6/1976 Sweet, II et al.
3,965,912 A 6/1976 Gross et al.
3,969,584 A 7/1976 Miller et al.
3,982,620 A 9/1976 Kortenhaus
3,984,660 A 10/1976 Oka et al.
3,998,237 A 12/1976 Kressin et al.
4,014,424 A 3/1977 Hall
4,036,242 A 7/1977 Breitenstein et al.
4,058,954 A 11/1977 Asami et al.
4,059,122 A 11/1977 Kinoshita
4,071,740 A 1/1978 Gogulski
4,083,776 A 4/1978 Shimoiizaka et al.
4,092,990 A 6/1978 Bayne
4,099,722 A 7/1978 Rodesch et al.
4,100,925 A 7/1978 Fukunaga et al.
4,106,610 A 8/1978 Heiman
4,109,774 A * 8/1978 Hayashi ..... 194/215
4,111,216 A 9/1978 Brisebarre et al.
4,124,109 A 11/1978 Bissell et al.
4,141,372 A 2/1979 Gdanski et al.
4,148,331 A 4/1979 Nicolaus
4,157,139 A 6/1979 Bjork
4,167,949 A 9/1979 Hashimoto et al.
4,172,462 A 10/1979 Uchida et al.
4,184,366 A 1/1980 Butler
4,216,461 A 8/1980 Werth et al.
4,225,056 A 9/1980 Flubacker
4,228,811 A 10/1980 Tanaka et al.
4,230,213 A 10/1980 Spring
4,236,999 A 12/1980 Burgess et al.
4,238,324 A 12/1980 Musselmann et al.
4,240,589 A 12/1980 Martin et al.
4,249,552 A 2/1981 Margolin et al.
4,266,121 A 5/1981 Hirose et al.
4,266,651 A 5/1981 Strom
4,275,751 A 6/1981 Bergman
4,278,543 A 7/1981 Maniquis et al.
4,301,909 A 11/1981 Snavely
4,306,644 A 12/1981 Rockola et al.
4,321,672 A 3/1982 Braun et al.
4,326,620 A 4/1982 Felix et al.
4,346,798 A 8/1982 Agey, III
4,356,829 A 11/1982 Furuya et al.
4,360,034 A 11/1982 Davila et al.
4,369,442 A 1/1983 Werth et al.
4,369,800 A 1/1983 Watanabe et al.
4,374,557 A 2/1983 Sugimoto et al.
4,376,442 A 3/1983 Gomez et al.
4,380,316 A 4/1983 Glinka et al.
4,383,540 A 5/1983 De Meyer et al.
4,398,550 A 8/1983 Shireman
4,412,292 A 10/1983 Sedam et al.
4,412,607 A 11/1983 Collins et al.
4,414,467 A 11/1983 Gould et al.
4,416,334 A 11/1983 Bouillon
4,434,359 A 2/1984 Watanabe et al.
4,436,103 A 3/1984 Dick
4,442,850 A 4/1984 Austin et al.
4,447,714 A 5/1984 Lundblad et al.
4,471,864 A 9/1984 Marshall
4,503,963 A 3/1985 Steiner
4,504,357 A 3/1985 Holbein et al.
4,506,685 A 3/1985 Childers et al.
4,509,122 A 4/1985 Agnew et al.
4,509,633 A 4/1985 Chow
4,512,453 A 4/1985 Schuller et al.
4,533,054 A 8/1985 Sommer, Jr. et al.
4,535,794 A 8/1985 Bellis et al.
4,535,915 A 8/1985 West
4,538,719 A 9/1985 Gray et al.
4,542,817 A 9/1985 Paulson
4,543,969 A 10/1985 Rasmussen
4,554,446 A 11/1985 Murphy et al.
4,555,618 A 11/1985 Riskin
4,556,140 A 12/1985 Okada et al.
4,558,711 A 12/1985 Yoshiaki et al.
4,574,824 A 3/1986 Paulsen et al.
4,577,744 A 3/1986 Doucet et al.
4,587,984 A 5/1986 Levasseur et al.
4,588,712 A 5/1986 Toscano
4,597,487 A 7/1986 Crosby et al.
4,598,378 A 7/1986 Giacomo
4,611,205 A 9/1986 Eglise et al.
4,616,323 A 10/1986 Hayashi
4,616,776 A 10/1986 Blumenthal et al.
4,620,559 A 11/1986 Childers et al.
4,622,456 A 11/1986 Naruto et al.
4,625,851 A 12/1986 Johnson et al.
4,641,239 A 2/1987 Takesako
4,667,093 A 5/1987 MacDonald et al.
4,672,377 A 6/1987 Murphy et al.
4,677,565 A 6/1987 Ogaki et al.
4,694,845 A 9/1987 Zay
4,706,577 A 11/1987 Jones et al.
4,706,795 A 11/1987 Mikami et al.
4,716,799 A 1/1988 Hartmann
4,723,212 A 2/1988 Mindrum et al.
4,733,765 A 3/1988 Watanabe et al.
4,753,625 A 6/1988 Okada et al.

(56) References Cited

U.S. PATENT DOCUMENTS 4,754,862 A 7/1988 Rawicz-Szczerbo et al.
4,767,917 A 8/1988 Ushikubo
4,775,353 A 10/1988 Childers et al.
4,775,354 A 10/1988 Rasmussen et al.
4,809,837 A 3/1989 Hayashi et al.
4,814,589 A 3/1989 Storch et al.
4,827,423 A 5/1989 Beasley et al.
4,831,374 A 5/1989 Masel
4,833,308 A 5/1989 Humble
4,836,352 A 6/1989 Tateno et al.
4,866,661 A 9/1989 de Prins
4,882,675 A 11/1989 Nichtberger et al.
4,882,724 A 11/1989 Vela et al.
4,883,158 A 11/1989 Kobayashi et al.
4,884,672 A 12/1989 Parker
4,895,238 A 1/1990 Speas
4,896,791 A 1/1990 Smith
4,898,564 A 2/1990 Gunn et al.
4,910,672 A 3/1990 Off et al.
4,915,205 A 4/1990 Reid et al.
4,921,463 A 5/1990 Primdahl et al.
4,936,436 A 6/1990 Keltner
4,953,086 A 8/1990 Fukatsu et al.
4,959,624 A 9/1990 Higgins, Jr. et al.
4,960,196 A 10/1990 Kanehara et al.
4,963,118 A 10/1990 Gunn et al.
4,964,495 A 10/1990 Rasmussen
4,969,549 A 11/1990 Eglise et al.
4,977,502 A 12/1990 Baker et al.
4,978,322 A 12/1990 Paulsen
4,995,848 A 2/1991 Goh et al.
4,997,406 A 3/1991 Horiguchi et al.
5,010,238 A 4/1991 Kadono et al.
5,021,967 A 6/1991 Smith
5,022,889 A 6/1991 Ristvedt et al.
5,025,139 A 6/1991 Halliburton, Jr.
5,027,937 A 7/1991 Parish et al.
5,039,848 A 8/1991 Stoken
5,040,657 A 8/1991 Gunn et al.
5,042,635 A 8/1991 Bell
5,055,657 A 10/1991 Miller et al.
5,056,644 A 10/1991 Parker
5,073,767 A 12/1991 Holmes et al.
5,083,765 A 1/1992 Kringel
5,083,814 A 1/1992 Guinta et al.
5,088,587 A 2/1992 Goodrich et al.
5,091,713 A 2/1992 Horne et al.
5,098,339 A 3/1992 Dabrowski
5,098,340 A 3/1992 Abe
5,100,367 A 3/1992 Abe et al.
5,111,927 A 5/1992 Schulze, Jr.
5,113,974 A 5/1992 Vayda
5,114,381 A 5/1992 Ueda et al.
5,122,094 A 6/1992 Abe et al.
5,131,885 A 7/1992 Nakao et al.
5,135,433 A 8/1992 Watanabe et al.
5,145,046 A 9/1992 Satoh et al.
5,151,684 A 9/1992 Johnsen
5,158,166 A 10/1992 Barson et al.
5,163,868 A 11/1992 Adams et al.
5,166,886 A 11/1992 Molnar et al.
5,167,571 A 12/1992 Waller
5,168,961 A 12/1992 Schneider
5,173,851 A 12/1992 Off et al.
5,174,608 A 12/1992 Benardelli et al.
5,183,142 A 2/1993 Latchinian et al.
5,195,626 A 3/1993 Le Hong et al.
5,201,396 A 4/1993 Chalabian et al.
5,217,100 A 6/1993 Thompson et al.
5,219,059 A 6/1993 Furuya et al.
5,222,584 A 6/1993 Zouzoulas
5,226,519 A 7/1993 DeWoolfson
5,227,874 A 7/1993 Von Kohorn
5,227,966 A 7/1993 Ichiba
5,236,339 A 8/1993 Nishiumi et al.
5,251,738 A 10/1993 Dabrowski
5,252,811 A 10/1993 Henochowicz et al.
5,254,032 A 10/1993 Abe et al.
5,279,404 A 1/1994 Bruner et al.
5,282,769 A 2/1994 Suzukawa
5,285,883 A 2/1994 Le Hong et al.
5,293,981 A 3/1994 Abe et al.
5,299,673 A 4/1994 Wu
5,302,811 A 4/1994 Fukatsu et al.
5,316,120 A 5/1994 Ibarrola
5,316,517 A 5/1994 Chiba et al.
5,317,135 A 5/1994 Finocchio
5,321,242 A 6/1994 Heath, Jr.
5,326,312 A 7/1994 Patroni
5,330,041 A 7/1994 Dobbins et al.
5,337,253 A 8/1994 Berkovsky et al.
5,345,071 A 9/1994 Dumont
5,347,115 A 9/1994 Sherman et al.
5,350,906 A 9/1994 Brody et al.
5,355,988 A 10/1994 Shirasawa
5,356,333 A 10/1994 Bointon et al.
5,360,093 A 11/1994 Baer
5,361,871 A 11/1994 Gupta et al.
5,365,046 A 11/1994 Haymann
5,374,814 A 12/1994 Kako et al.
5,386,902 A 2/1995 Bointon et al.
5,388,680 A 2/1995 Hird et al.
5,408,417 A 4/1995 Wilder
5,409,092 A 4/1995 Itako et al.
5,421,147 A 6/1995 Holden et al.
5,429,222 A 7/1995 Delay et al.
5,429,551 A 7/1995 Uecker et al.
5,435,777 A 7/1995 Takatani et al.
5,441,139 A 8/1995 Abe et al.
5,448,226 A 9/1995 Failing, Jr. et al.
5,449,058 A 9/1995 Kotler et al.
5,457,305 A 10/1995 Akel et al.
5,461,561 A 10/1995 Ackerman et al.
5,469,951 A 11/1995 Takemoto et al.
5,477,952 A 12/1995 Castellano et al.
5,480,061 A 1/1996 Ellinger
5,483,363 A 1/1996 Holmes et al.
5,484,334 A 1/1996 Evdokimo
5,496,211 A 3/1996 Zimmermann
5,499,707 A 3/1996 Steury
5,506,393 A 4/1996 Ziarno
5,513,738 A 5/1996 Hird et al.
5,531,640 A 7/1996 Inoue
5,535,872 A 7/1996 Smith et al.
5,546,316 A 8/1996 Buckley et al.
5,554,070 A 9/1996 Takatoshi et al.
5,555,497 A 9/1996 Helbling
5,560,467 A 10/1996 Takemoto
5,564,546 A 10/1996 Molbak et al.
5,573,099 A 11/1996 Church et al.
5,577,959 A 11/1996 Takemoto et al.
5,579,887 A 12/1996 Leibu et al.
5,583,487 A 12/1996 Ackerman et al.
5,595,264 A 1/1997 Trotta, Jr.
5,616,074 A 4/1997 Chen et al.
5,620,079 A 4/1997 Molbak
5,624,017 A 4/1997 Plesko
5,637,845 A 6/1997 Kolls
5,641,050 A 6/1997 Smith et al.
5,650,604 A 7/1997 Marcous et al.
5,652,421 A 7/1997 Veeneman et al.
5,665,952 A 9/1997 Ziarno
5,679,070 A 10/1997 Ishida et al.
5,695,395 A 12/1997 Ota et al.
5,696,908 A 12/1997 Muehlberger et al.
5,699,328 A 12/1997 Ishizaki et al.
5,704,049 A 12/1997 Briechle
5,711,704 A 1/1998 Hughes et al.
5,732,398 A 3/1998 Tagawa
5,743,429 A 4/1998 Morofsky
5,745,706 A 4/1998 Wolfberg et al.
5,746,299 A 5/1998 Molbak et al.
5,746,322 A 5/1998 LaVeine et al.
5,788,046 A 8/1998 Lamah et al.

(56) References Cited

U.S. PATENT DOCUMENTS 5,799,767 A 9/1998 Molbak
5,806,651 A 9/1998 Carmen et al.
5,839,956 A 11/1998 Takemoto et al.
5,842,916 A 12/1998 Gerrity et al.
5,868,236 A 2/1999 Rademacher
5,875,110 A 2/1999 Jacobs
5,880,444 A 3/1999 Shibata et al.
5,898,383 A 4/1999 Forsythe
5,901,828 A 5/1999 Monie et al.
5,909,792 A 6/1999 Gerlier et al.
5,909,793 A 6/1999 Beach et al.
5,909,794 A 6/1999 Molbak et al.
5,910,044 A 6/1999 Luciano, Jr. et al.
5,929,366 A 7/1999 Kennedy
5,936,541 A 8/1999 Stambler
5,941,363 A 8/1999 Partyka et al.
5,957,262 A 9/1999 Molbak et al.
5,974,146 A 10/1999 Randle et al.
5,975,276 A 11/1999 Yeh
5,988,345 A 11/1999 Bergeron et al.
5,988,348 A 11/1999 Martin et al.
5,991,413 A 11/1999 Arditti et al.
6,016,481 A 1/2000 Failing, Jr. et al.
6,017,063 A 1/2000 Nilssen
6,021,883 A 2/2000 Casanova et al.
6,030,284 A * 2/2000 Frank ..... 453/3
6,042,471 A 3/2000 Tanaka
6,047,807 A 4/2000 Molbak
6,047,808 A 4/2000 Neubarth et al.
6,053,300 A 4/2000 Wood et al.
6,053,807 A 4/2000 Metzger et al.
6,056,104 A 5/2000 Neubarth et al.
6,059,650 A 5/2000 Stoltz et al.
6,068,550 A 5/2000 Breitholtz et al.
6,071,187 A 6/2000 Knutsson et al.
6,082,519 A 7/2000 Martin et al.
6,093,094 A 7/2000 Uecker et al.
6,095,313 A 8/2000 Molbak et al.
6,095,916 A 8/2000 Tamaki
6,105,009 A 8/2000 Cuervo
6,110,044 A 8/2000 Stern
6,116,402 A 9/2000 Beach et al.
6,119,099 A 9/2000 Walker et al.
6,138,106 A 10/2000 Walker et al.
6,144,946 A 11/2000 Iwamura
6,168,001 B1 1/2001 Davis
6,174,230 B1 1/2001 Gerrity et al.
6,179,703 B1 1/2001 Knutsson et al.
6,185,545 B1 2/2001 Resnick et al.
6,196,371 B1 3/2001 Martin et al.
6,227,343 B1 5/2001 Neathway et al.
6,230,928 B1 5/2001 Hanna et al.
6,233,564 B1 5/2001 Schulze, Jr.
6,253,809 B1 7/2001 Paradies
6,264,104 B1 7/2001 Jenkins et al.
6,289,324 B1 9/2001 Kawan
6,292,211 B1 9/2001 Pena
6,318,536 B1 11/2001 Korman et al.
6,349,972 B1 2/2002 Geiger et al.
6,375,080 B1 4/2002 Cremonese
6,398,637 B1 6/2002 Tsuchida
6,401,010 B1 6/2002 Takahashi
6,404,090 B1 6/2002 Phillips et al.
6,405,182 B1 6/2002 Cuervo
6,415,262 B1 7/2002 Walker et al.
6,471,030 B1 10/2002 Neubarth et al.
6,484,863 B1 11/2002 Molbak
6,484,884 B1 11/2002 Gerrity et al.
6,494,776 B1 12/2002 Molbak
6,505,774 B1 1/2003 Fulcher et al.
6,520,308 B1 2/2003 Martin et al.
6,536,037 B1 3/2003 Guheen et al.
6,554,184 B1 4/2003 Amos
6,607,063 B2 8/2003 Kuwabara et al.
6,609,604 B1 * 8/2003 Jones et al. ..... 194/302
6,666,318 B2 12/2003 Gerrity et al.
6,704,039 B2 3/2004 Pena
6,705,448 B1 3/2004 Steel
6,725,630 B2 4/2004 Rea et al.
6,736,251 B2 5/2004 Molbak
6,758,316 B2 7/2004 Molbak
6,766,892 B2 7/2004 Martin et al.
6,778,693 B2 8/2004 Jones et al.
6,817,052 B2 11/2004 Grube
6,829,596 B1 12/2004 Frazee
6,854,581 B2 2/2005 Molbak
6,863,168 B1 3/2005 Gerrity et al.
6,976,570 B2 12/2005 Molbak
7,017,729 B2 3/2006 Gerrity et al.
7,028,827 B1 4/2006 Molbak et al.
7,113,929 B1 9/2006 Beach et al.
7,131,580 B2 11/2006 Molbak
7,213,697 B2 5/2007 Martin et al.
7,290,645 B2 11/2007 Hill et al.
7,303,119 B2 12/2007 Molbak
7,464,802 B2 * 12/2008 Gerrity et al. ..... 194/347
7,520,374 B2 4/2009 Martin et al.
7,527,193 B2 5/2009 Molbak
7,658,668 B2 2/2010 Hill
7,865,432 B2 1/2011 Doran et al.
7,874,478 B2 1/2011 Molbak
7,971,699 B2 7/2011 Molbak et al.
8,109,379 B2 * 2/2012 Sjostrom ..... 194/215
8,522,950 B2 9/2013 Martin
8,550,227 B1 10/2013 Martin
2001/0008200 A1 7/2001 Yoshida et al.
2001/0014838 A1 8/2001 Abe et al.
2002/0026423 A1 2/2002 Maritzen et al.
2003/0057054 A1 3/2003 Waechter
2003/0201146 A1 10/2003 Abe et al.
2004/0048566 A1 3/2004 Maki
2006/0019591 A1 1/2006 Abe et al.
2006/0025062 A1 2/2006 Masen et al.
2006/0113161 A1 * 6/2006 Umeda ..... 194/302
2007/0060033 A1 * 3/2007 Kotani ..... 453/56
2008/0085671 A1 4/2008 Nishida
2008/0171508 A1 7/2008 Enomoto et al.
2009/0004959 A2 1/2009 Nishida
2009/0159395 A1 6/2009 Gerrity et al.
2009/0166151 A1 7/2009 Martin et al.
2009/0178897 A1 * 7/2009 Molbak ..... 194/217
2010/0227539 A1 9/2010 Aguado Vitas et al.
2010/0330892 A1 12/2010 Nishida
2011/0189933 A1 8/2011 Hoffges
2011/0259709 A1 10/2011 Grossmann
2013/0086973 A1 4/2013 Martin et al.
2014/0335770 A1 11/2014 Martin

FOREIGN PATENT DOCUMENTS

AU 753323 10/2002
AU 777507 10/2004
AU 2005200256 2/2005
CA 1053598 5/1979
CA 2060630 8/1992
CA 2067987 11/1992
CA 2143943 3/1994
CA 2189330 11/1995
CA 2235925 11/1995
CA 2259234 1/1998
CA 2426462 1/1998
CA 2295129 1/1999
CA 2426411 4/2013
CA 2581740 6/2013
CH 680171 6/1992
DE 660354 5/1938
DE 1944488 3/1971
DE 2516532 10/1975
DE 2528735 4/1976
DE 2800494 7/1979
DE 3021327 12/1981
DE 3147603 6/1983
DE 288018 3/1991
DE 69523309 10/2001

(56) References Cited

FOREIGN PATENT DOCUMENTS

| | | | |
|---|---|---|---|
| EP | 0060392 | | 9/1982 |
| EP | 0091731 | | 10/1983 |
| EP | 0164733 | A2 | 12/1985 |
| EP | 0200873 | | 11/1986 |
| EP | 0209357 | | 1/1987 |
| EP | 0300781 | | 1/1989 |
| EP | 0304535 | | 3/1989 |
| EP | 0 351 217 | | 1/1990 |
| EP | 0420163 | | 4/1991 |
| EP | 0477722 | | 4/1992 |
| EP | 0657855 | | 6/1995 |
| EP | 0685826 | | 12/1995 |
| EP | 0710932 | | 5/1996 |
| EP | 0724237 | | 7/1996 |
| EP | 0857579 | | 8/1998 |
| EP | 0924662 | | 6/1999 |
| EP | 0924664 | | 6/1999 |
| EP | 0924665 | | 6/1999 |
| EP | 0766859 | | 10/2001 |
| EP | 1178448 | | 2/2002 |
| EP | 1231579 | | 8/2002 |
| EP | 1646014 | | 4/2006 |
| EP | 1939821 | | 7/2008 |
| EP | 1956563 | | 8/2008 |
| EP | 2226769 | A1 | 9/2010 |
| EP | 2754136 | | 7/2014 |
| FR | 2042254 | | 2/1971 |
| FR | 2342531 | | 9/1977 |
| FR | 2845189 | | 4/2004 |
| GB | 958741 | | 5/1964 |
| GB | 1255492 | | 12/1971 |
| GB | 1564723 | | 4/1980 |
| GB | 2095452 | | 9/1982 |
| GB | 2121582 | | 12/1983 |
| GB | 2153128 | | 8/1985 |
| GB | 2169429 | | 7/1986 |
| GB | 2175427 | | 11/1986 |
| GB | 2186411 | | 8/1987 |
| GB | 2188467 | | 9/1987 |
| GB | 2198274 | | 6/1988 |
| GB | 2223340 | | 4/1990 |
| GB | 2223872 | | 4/1990 |
| GB | 2225918 | A | 6/1990 |
| GB | 2237912 | A | 5/1991 |
| GB | 2255666 | | 11/1992 |
| GB | 2341710 | | 3/2000 |
| GB | 2341711 | | 3/2000 |
| GB | 2356966 | | 6/2001 |
| GB | 2357885 | | 7/2001 |
| GB | 2357886 | | 7/2001 |
| GB | 2358271 | | 7/2001 |
| GB | 2358272 | | 7/2001 |
| GB | 2358273 | | 7/2001 |
| JP | 5249892 | | 4/1977 |
| JP | 5250296 | | 4/1977 |
| JP | 53049497 | | 5/1978 |
| JP | 0097469 | | 5/1985 |
| JP | 62-50876 | | 3/1987 |
| JP | 1258092 | | 10/1989 |
| JP | 1307891 | | 12/1989 |
| JP | 2081193 | | 3/1990 |
| JP | 3-63795 | | 3/1991 |
| JP | 392994 | | 4/1991 |
| JP | 3252795 | | 11/1991 |
| JP | 0433194 | | 4/1992 |
| JP | 4067776 | | 6/1992 |
| JP | 4315288 | | 11/1992 |
| JP | 4344995 | | 12/1992 |
| JP | 5-200364 | | 8/1993 |
| JP | 07306976 | | 11/1995 |
| MX | 9605331 | | 12/1997 |
| NZ | 333535 | | 8/2000 |
| SE | 44244 | | 9/1988 |
| SE | 44247 | | 9/1988 |
| SE | 8801851 | | 11/1989 |
| SE | 50250 | | 8/1991 |
| WO | WO-8700102 | | 1/1987 |
| WO | WO-8705729 | | 9/1987 |
| WO | WO-8800274 | | 1/1988 |
| WO | WO-8800592 | | 1/1988 |
| WO | WO-8808174 | | 10/1988 |
| WO | WO-8901209 | | 2/1989 |
| WO | WO-9100209 | | 1/1991 |
| WO | WO-9302431 | | 2/1993 |
| WO | WO-9307846 | A1 | 4/1993 |
| WO | WO-9406101 | | 3/1994 |
| WO | WO-9409440 | | 4/1994 |
| WO | WO-9505356 | | 2/1995 |
| WO | WO-95/30215 | | 11/1995 |
| WO | WO-96/30877 | | 10/1996 |
| WO | WO-9707485 | | 2/1997 |
| WO | WO-97/33257 | | 9/1997 |
| WO | WO-9950785 | | 10/1999 |
| WO | WO-0010138 | | 2/2000 |
| WO | WO-2008024043 | | 2/2008 |

OTHER PUBLICATIONS

Accessories Brochure, Jun. 16, 2005, 3 pages.
Bedienungsanleitung CDS 500/MCC 500, 1991, 9 pages.
"CDS Automated Receipt Giving Cash Deposit System," Case—ICC Limited, Dated prior to Mar. 2, 2011, 3 pages.
Cash, M., "Bank Blends New Technology with Service", Winnipeg Free Press, Sep. 4, 1992, 1 page.
Cohen, P., "Coinstar Turns Loose Change into iTunes Songs," Yahoo News, http://news.yahoo.com/s/macworld/20060410/tc_macworld/coinstar20060410_0, Apr. 10, 2006, pp. 1-3.
F. Zimmerman & Co., "Reference Manual Contovit/Sortovit, Perconta Money Counting and Sorting Systems," Aug. 1995, pp. I-III, 1-31, and three pages of specifications.
Fri Kopenskap articles, Mar. 18, 1988, Apr. 27, 1989 and Nov. 25, 1988, 6 pages.
Geldinstitute Literature, Mar. 1990 and Apr.-May 1992, 2 pages.
Hamilton, "Turning Cans into Cold Cash," The Washington Post, Jul. 2, 1991, pp. D1, D4, pp. 194-209.
Kundenselbstbedienung, Dec. 22, 2006, 4 pages.
Kunderna fixar vaxeln, Praktiska, Dec. 12, 2006, 2 pages.
Leitch, C., "High-tech Bank Counts Coins," Innovations, Report on Business, Sep. 18, 1991, 1 page.
Liemeon, J., "Royal's Burlington Drive-in Bank Provides Customers 24-hour Tellers," Business Today, The Toronto Star, Aug. 21, 1991, 1 page.
NCR, "NCR 7800 Consumer Price Verifier," http://www3.ncr.com/product/retail/product/catalog/7800.shtml, accessed Mar. 18, 1999, 2 pages.
Oxby, M., "Royal Bank Opens 'Super Branch,'" The Gazette Montreal, Sep. 14, 1991, 1 page.
Reis Eurosystems Geldbearbeitungssysteme, "Test-Programme CS 3110 Selectronic Coin Sorting and Counting Machine," Jul. 1992, 5 pages.
Reis Eurosystems, "Operating Instructions CS 3110 Selectronic Coin Sorting and Counting Machine with Central Sensor," Jul. 1992, 10 pages.
SC4000 Coin Discriminating System, Including Perforated, Vibrating Coin Feeding and Cleaning Tray Assembly; On sale in the US by Scan Coin Since at least Dec. 1994 (including photographs, drawings and parts lists), 92 pages.
Scan Coin 102 Value Counter, Brochure, Undated, 2 pages.
Scan Coin 4000 Value Sorter, Operator's Instruction Manual, Jun. 1995, 56 pages.
Scan Coin AB, "Scan Coin 4000 Value Sorter" and product photos, on sale in the U.S. prior to Sep. 2001, 11 pages.
Scan Coin AB, 1989, Jagershillgatan 26, S-213, 75 Malmo, Sweden, Technical Referens Manual, CDS Coin Deposit System, 47 pages.
Scan Coin CDS 600 Cash Deposit System, Brochure, Jun. 15, 1994, 2 pages.
Scan Coin CDS 640 Cash Deposit System Brochure, published at least by May 12, 2006, 2 pages.
Scan Coin CDS Brochure, Sep. 1988, 6 pages.

(56) References Cited

OTHER PUBLICATIONS

Scan Coin CDS Mini Cash Deposit System, Brochure, Undated, 2 pages.
Scan Coin CDS Munzgeldeinzahlungen in Selbstbedienung: Cash Deponier System CDS 500, 1994, 6 pages.
Scan Coin correspondence regarding supermarkets, Sep. 11, 1992, 4 pages.
Scan Coin International Report, Apr. 1987, 49 pages.
Scan Coin Money Processing Systems, Oct. 1, 1988, 9 pages.
Scan Coin Newsletter, May 1991, 2 pages.
Scan Coin Sales Invoices for Coin Counters in the United States, 1989-1993, 29 pages.
Scan Coin SC4000 Operating Instructions, dated Aug. 10, 1994, 6 pages.
Scan Coin Technical Manual CDS MK 1 Coin Deposit System; 1991, 98 pages.
Scan Coin Technical Manual SC 102 Value Counter, Available prior to Jul. 2011, 28 pages.
Scan Coin Technical Manual SC4000, dated Jul. 29, 1994, 12 pages.
Scan Coin Technical Reference Manual CDS Coin Deposit System (odd pages only) 1989, 47 pages.
Scan Coin User's Manual, CDS 600, 1991, 14 pages.
Scan Coin User's Manual, CDS 640, 1988, 7 pages.
Scan Coin World Newsletters, Scan Coin AB, Jagerhillgatan 26, S-213 75 Malmo, Sweden, 1988-1990, 6 pages.
Sheehan, Michael, "Marriage of Convenience," available at <http://www.kioskbusiness.com/NovDec01/articles/article4.html>, accessed May 19, 2003, 3 pages.
Slide Changing Apparatus With Slide Jam Protection, Research Disclosure 30509, Sep. 1989, 3 pages.
Super Branch Literature, Feb. 1992, 2 pages.
Svenska Penninglotteriet Documents, 1988, 70 pages.
Technical Manual, Cash Deposit System, Model CDS 600 & CDS 640, 1991, 46 pages.
Technical Specifications GBS9401 SB, Prior to Nov. 10, 2010, 24 pages.
Wennergren-Williams, "Who Wants a Computer Consultant Who Thinks the Same Way as Everyone Else?", Priab Prisma, vol. 1, 1989, 7 pages.
U.S. Appl. No. 13/489,043, filed Jun. 5, 2012, Borg et al.
U.S. Appl. No. 13/691,047, filed Nov. 30, 2012, Everhart.
Extended European Search Report for European Application No. EP14156057, Mail Date May 28, 2014, 8 pages.
U.S. Appl. No. 09/035,273, filed Mar. 9, 1998, Molbak et al.
U.S. Appl. No. 09/225,774, filed Jan. 4, 1999, Molbak et al.
U.S. Appl. No. 14/177,213, filed Feb. 10, 2014, Martin et al.

* cited by examiner

COIN COUNTING AND SORTING MACHINES

TECHNICAL FIELD

The following disclosure relates generally to coin processing machines and, more particularly, to machines for counting and sorting coins, such as consumer coins and the like.

BACKGROUND

Various types of consumer coin counting machines are known. Some coin counting machines (e.g., vending machines, gaming devices such as slot machines, and the like) are configured to receive one coin at a time through a slot. These types of machines are typically relatively simple because the coin input slot can define the maximum coin diameter and thickness, and because they are typically designed for low throughput and little if any coin cleaning. Such machines, however, are usually not satisfactory for counting a mass of consumer coins received at once (such as a mass of coins poured into a tray from, e.g., a coin jar).

Machines for counting relatively large quantities of consumer coins include those disclosed in, for example: U.S. Pat. Nos. 7,971,699, 7,874,478, 7,520,374, 8,033,375 and 8,332,313; each of which is incorporated herein by reference in its entirety. Some of these machines count consumer coins and dispense redeemable cash vouchers, while others may offer other types of products and services such as pre-paid gift cards, prepaid phone cards, and/or "e-certificates." Vouchers can be redeemed for cash and/or merchandize at a point of sale (POS) in a retail establishment. E-certificates can enable the holder to purchase items online by inputting a code from the e-certificate when making the purchase. Prepaid gift cards can be used to make POS purchases by swiping the card through a conventional card reader, and prepaid phone cards can be used for making cell phone calls. All such machines typically include sensors and similar devices for discriminating coin denominations, coins from non-coin objects, and/or coins of one country from those of another.

Various types of sensors and other devices for identifying and/or discriminating coins in coin-counting machines are known. Such devices include those disclosed in, for example: U.S. Pat. Nos. 6,196,371 and 5,988,348; and U.S. patent application Ser. No. 13/269,121, filed Oct. 7, 2011 and entitled "AUTO-CALIBRATION SYSTEMS FOR COIN COUNTING DEVICES," Ser. No. 13/489,043, filed Jun. 5, 2012, and entitled "OPTICAL COIN DISCRIMINATION SYSTEMS AND METHODS FOR USE WITH CONSUMER-OPERATED KIOSKS AND THE LIKE," Ser. No. 13/612,429, filed Sep. 12, 2012, and entitled "AUTO-POSITIONING SENSORS FOR COIN COUNTING DEVICES," and Ser. No. 13/691,047, filed Nov. 30, 2012, and entitled "DIFFERENTIAL DETECTION COIN DISCRIMINATION SYSTEMS AND METHODS FOR USE WITH CONSUMER-OPERATED KIOSKS AND THE LIKE;" each of which is incorporated herein by reference in its entirety.

Some coin counting machines collect all the coins they receive in a single receptacle regardless of denomination. As a result, the coins must be sorted by denomination after removal from the machine and before they can be put back into service. Accordingly, it would be advantageous to provide a coin processing machine that can count and sort large batches of coins.

DETAILED DESCRIPTION

The following disclosure describes various embodiments of coin processing machines that can count and sort coins. In various embodiments, the coin processing machines described herein are consumer-operated coin processing machines configured to receive large batches of random coins from users in exchange for, e.g., redeemable cash vouchers, prepaid cards (e.g., gift cards), e-certificates, etc. Certain details are set forth in the following description and in FIGS. 1-4 to provide a thorough understanding of various embodiments of the present technology. In some instances well-known structures, materials, operations and/or systems often associated with coin counting machines are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the invention. Moreover, many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers typically identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

Figure 1A:
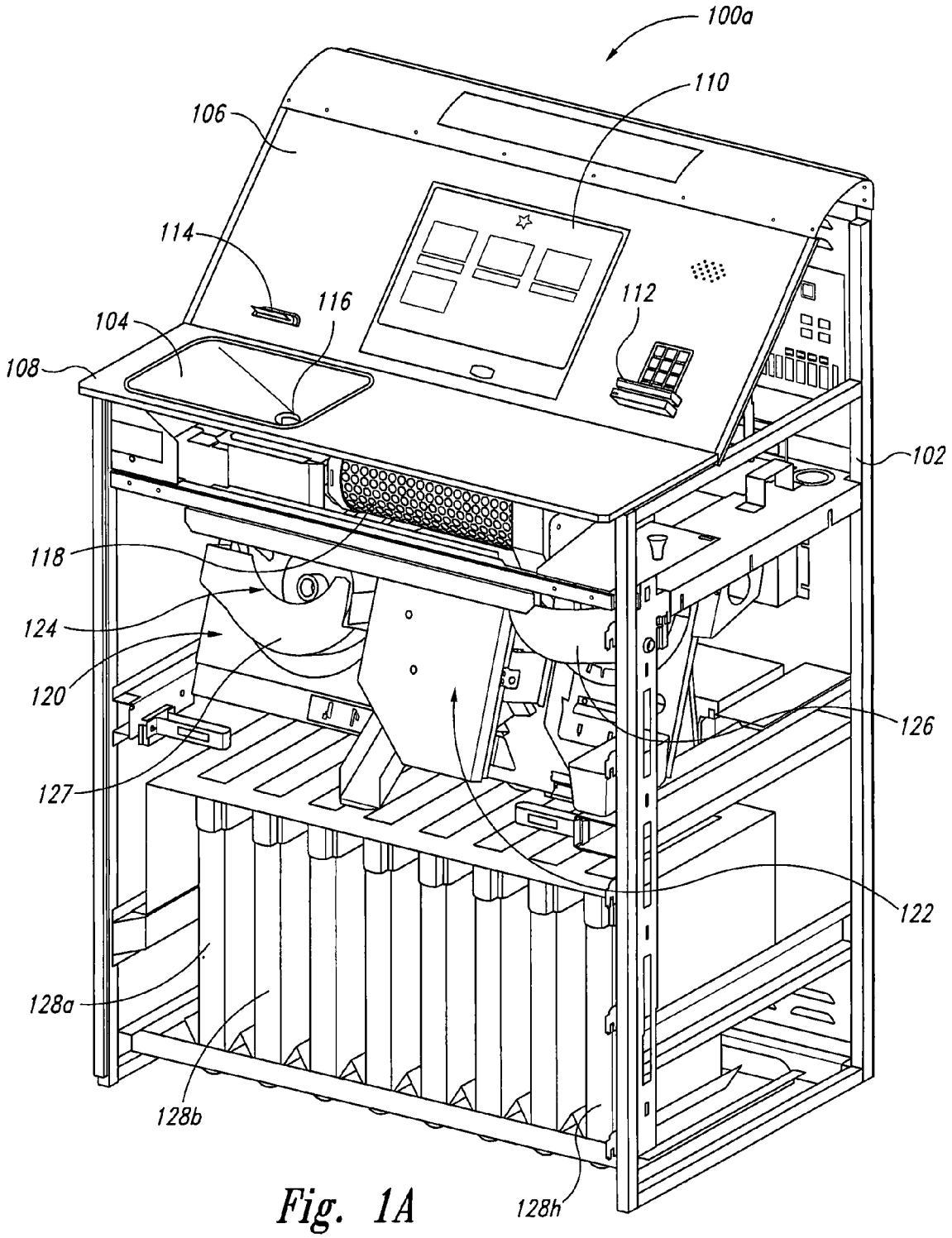
FIGS. 1A and 1B are isometric views of a coin processing machine configured in accordance with embodiments of the present technology.
Figure 1B:
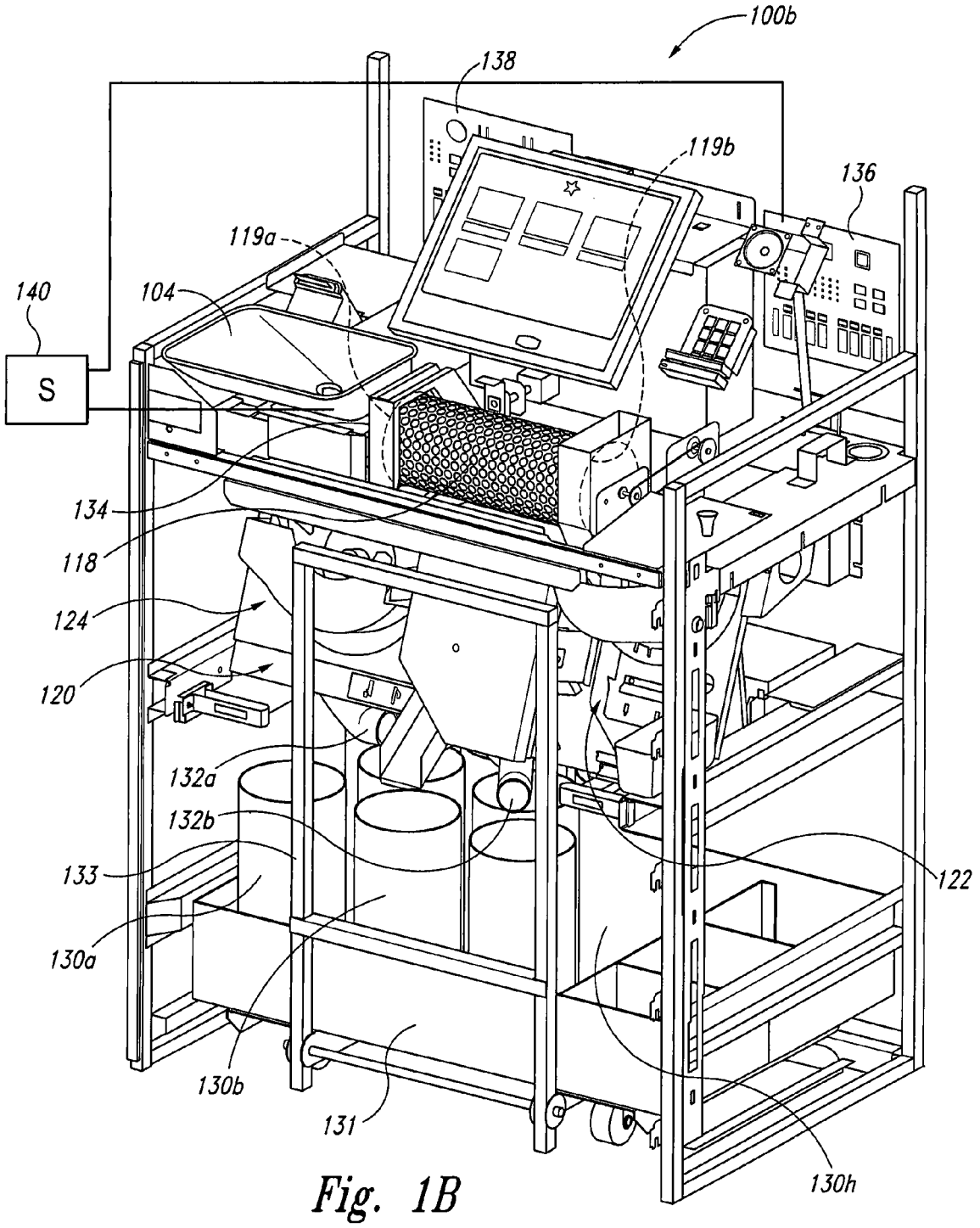

FIGS. 1A and 1B are isometric views of coin processing machines 100*a* and 100*b*, respectively, configured in accordance with embodiments of the present technology. In FIGS. 1A and 1B, certain exterior panels and/or other portions of the coin processing machines 100 have been removed to better illustrate interior structures and systems of the machines. Moreover, the main difference between the coin processing machine 100*a* shown in FIG. 1A and the coin processing machine 100*b* shown in FIG. 1B is that the two machines use two different types of coin receptacle for collecting counted and sorted coins. Otherwise, the two coin processing machines 100*a* and 100*b* are essentially the same and will be referred to hereinafter as the coin processing machine 100 for ease of reference.

Referring to FIGS. 1A and 1B together, the coin processing machine 100 (the "coin machine 100") includes a horizontal service counter or shelf 108 mounted on a chassis 102. The shelf 108 supports a coin input region or basin 104 configured to receive large batches of coins (not shown) from consumers and/or other users. In the illustrated embodiment, the coin machine 100 further includes a user panel 106 positioned behind the shelf 108 that carries a number of user interface devices to facilitate use of the coin machine 100. For example, the user panel 106 can include a display 110, such as a display screen or LCD screen for providing users with prompts and other instructions for use of the machine 100. As those of ordinary skill in the art will appreciate, the display 110 can include touch pads and/or similar user input features enabling the user to select different operating parameters, products, and/or services of the machine 100. In other embodiments, the coin machine 100 can include keypads and/or other conventional user input devices for receiving instructions and/or other information from users. The service panel 106 can also include an outlet 114 for dispensing, e.g., redeemable vouchers and/or receipts to users in return for coins. The user panel 106 can further include a card reader 112 for reading (and/or writing to), e.g., magnetic stripes and/or other information storage media on various types of cards, such as prepaid cards, credit cards, identification cards, etc.

In operation, coins dumped into the basin 104 pass through one or more apertures or outlets 116 positioned toward a lower portion of the basin 104 and into a chute 134. The chute 134 delivers the coins into a first opening 119*a* of a coin cleaner 118 positioned below the shelf 108. In the illustrated embodiment, the coin cleaner 118 is a rotating coin cleaning drum (e.g., a "trammel") that tumbles the coins as it moves them along the length of the coin cleaner 118 and out a second opening 119*b*. Such coin cleaning devices are described in detail in, for example, U.S. Pat. No. 7,464,802, which is incorporated herein in its entirety by reference.

In one aspect of this embodiment, the coin machine 100 further includes a coin processing unit 120 mounted in the chassis 102 beneath the coin cleaner 118. The coin processing unit 120 includes a coin counting portion having coin counter 122 and a coin sorting portion having a coin sorter 124. In the illustrated embodiment, the coin counter 122 includes a first coin hopper 126 and the coin sorter 124 includes a second coin hopper 127. Clean coins exiting the second opening 119*b* of the coin cleaner 118 fall into the first coin hopper 126 (the "first hopper 126"). As described in detail below, the coin counter 122 includes a rotating coin disk that lifts coins out of the first hopper 126 and places them onto a coin rail where they travel past a coin sensor for discrimination and counting. Coins that are properly counted then continue down the coin rail and into the second coin hopper 127 (the "second hopper 127") for sorting. As also described in detail below, the coin sorter 124 also includes a rotating coin disk that lifts the coins out of the second hopper 127 and sorts them according to denomination.

In the illustrated embodiment, the coin machine 100 can further include one or more controllers for controlling operation of the various apparatuses and systems described above. For example, in the illustrated embodiment the coin processing machine 100 can include a first controller 136 for controlling operation of, e.g., the coin counter 122, and a second controller 138 for controlling operation of, e.g., the coin sorter 124. As those of ordinary skill in the art will appreciate, the controllers 136 and 138 can include, for example, programmable logic controllers (PLCs), and/or other types of processing, memory, and associated circuitry for controlling operation of the coin machine 100 according to computer readable instructions stored on suitable computer-readable media.

In some embodiments, the coin machine 100 can further include an "auto start" feature. More specifically, in these embodiments the coin machine 100 can include a sensor 140 (shown schematically in FIG. 1B), such as a vibration sensor, operably coupled and/or mounted to an underside portion of the coin basin 104. The sensor 140 can be configured to sense coins being dumped, poured, or otherwise placed into the basin 104, and send a corresponding signal to the first controller 136. The first controller 136 can be configured to automatically start rotation of the coin cleaner 118 (and, e.g., the coin counter 122 and the coin sorter 124) in response to the signal, thereby drawing coins into the coin cleaner 118 through the chute 134. In this way, the coin machine 100 does not require the user to input "start" instructions. Instead, the coin machine automatically starts when the user dumps his or her coins into the basin 104. In other embodiments, a vibration sensor can be mounted to the coin chute 134, and/or other types of sensors can be used to automatically sense or detect the presence of coins in the basin 104 and automatically turn the coin machine 100 on. In yet other embodiments, the machine 100 can require the user to input a start instruction to begin and/or continue a coin counting session.

In the embodiment illustrated in FIG. 1A, the coin machine 100*a* sorts the counted coins into a series of removable coin receptacles or bins 128 (identified individually as coin bins 128*a*-128*h*) positioned in a lower portion of the chassis 102. In some embodiments, the number of coin bins 128 used to hold the different coin denominations can vary depending on the expected prevalence of particular denominations during operation. For example, in one embodiment multiple coin bins 128 (e.g., 128*a*-*c*) can be used to hold pennies because they may tend to make up a large portion of the coins deposited by users, while single coin bins 128 (e.g., 128*d*-128*h*) can be used to hold other less prevalent denominations like dimes, nickels, quarters, and dollar/fifty cent pieces, respectively.

Although removable coin bins 128 are illustrated in FIG. 1A, in other embodiments other types of coin receptacles can be used for storage and transport of the sorted coins. As shown in FIG. 1B, for example, the coin machine 100 can alternatively include a plurality of coin drums 130 for collecting the various coin denominations. In this embodiment, the individual coin drums 130 can be fed coins of specific denominations by an arrangement of feed tubes 132. As described in greater detail below, each of the feed tubes is configured to receive a particular coin denomination from the coin sorter 124 and dispense the single denomination into a selected drum 130. In some embodiments, each of the feed tubes 132 can be automatically moveable and driven (by, e.g., a suitable electric motor—not shown) to position the respective tube outlets over an empty or new coin drum 130 when a previous coin drum becomes full of a specific coin denomination. In these embodiments, each of the coin drums 130 can be operatively connected to one or more sensors (not shown) that automatically determine when a particular drum is full. When one of the coin drums 130 is full, the associated sensor can send a control signal to the corresponding feed tube outlet, causing the outlet to move to another (e.g., empty) coin drum 130. Once a sufficient number of the coin drums 130 is full, the coin machine 100 can send an associated signal via a suitable communication facility to a remote operator station indicating that the coin drums 130 are sufficiently full and should be removed and replaced. In a further aspect of this embodiment, the coin drums 130 (and, similarly, the coin bins 128) can be carried by a movable dolly 131 having an associated handle 133 for easy removal and replacement of the coin drums 130 from within the coin machine 100.

Figure 2:
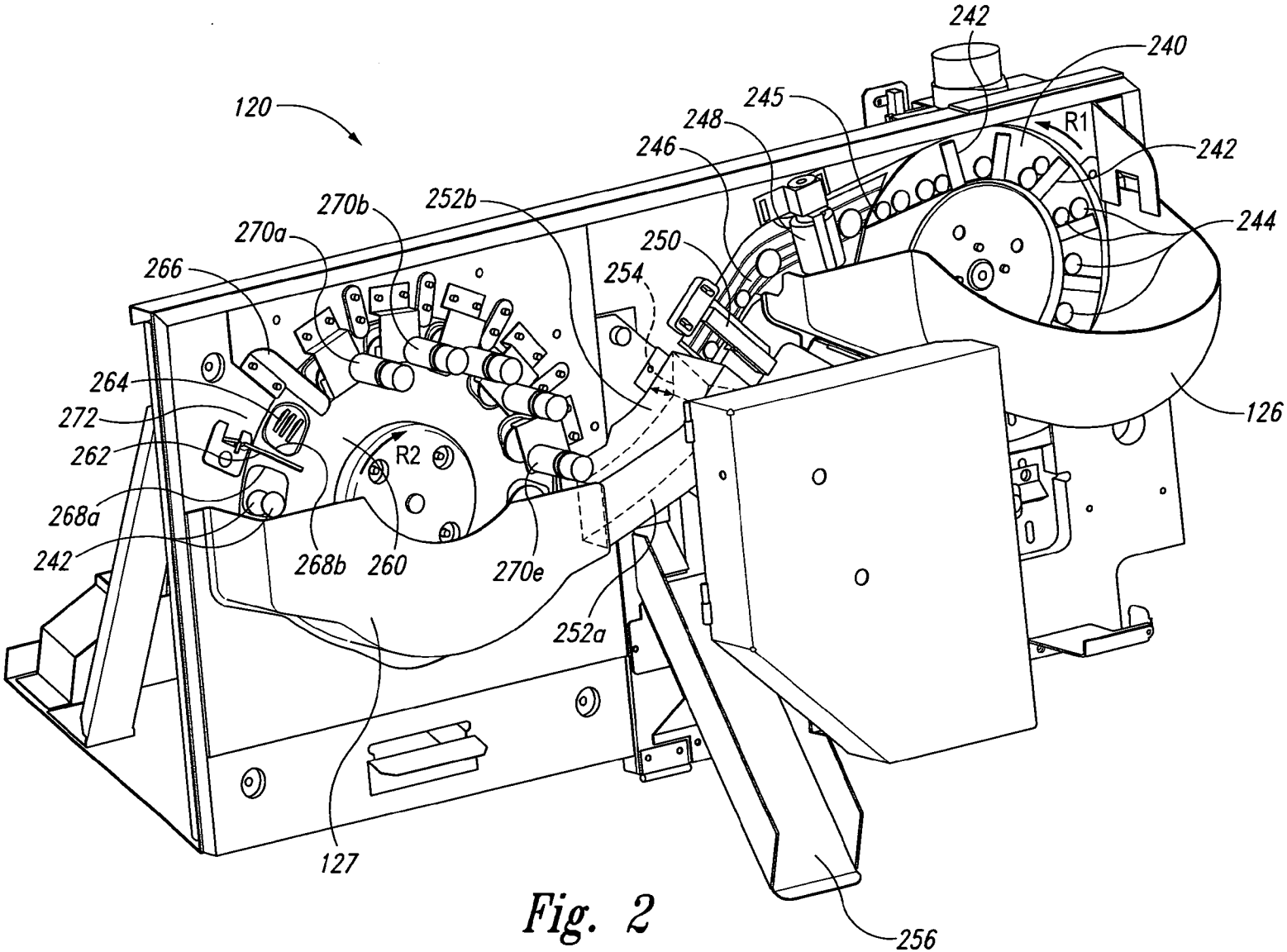
FIG. 2 is an enlarged front isometric view of a coin processing unit configured in accordance with an embodiment of the present technology.

FIG. 2 is an enlarged front isometric view of the coin processing unit 120 from the coin machine 100 of FIGS. 1A and 1B. As discussed above, the coin counter 122 includes a first coin disk 240 and the coin sorter 124 includes a second coin disk 260. In the illustrated embodiment, the first coin disk 240 and the second coin disk 260 revolve about central axes positioned at generally the same elevation (e.g., side by side rather than one above the other) and, as a result, the coin processing machine 100 has a relatively low profile. In operation, coins 244 fall into the first hopper 126 from the coin cleaner 118 as described above with reference to FIGS. 1A and 1B. The shape of the first hopper 126 causes the coins 244 to collect against the lower portion of the slightly inclined first coin disk 240. The first coin disk 240 rotates in direction R1 and lifts coins from the first hopper 126 on a series of paddles 242. The paddles 242 carry the coins 244 upwardly and place them at an entrance 245 to a coin rail 246. A coin peeler or similar device (not shown) can be used to knock grouped or misplaced coins off of the rail entrance 245 and back into the first hopper 126. Alternatively (or additionally), a debris diverter 248 can be positioned adjacent the coin rail 246 to ensure that the coins 244 proceed down the rail 246 in single file. In the illustrated embodiment, the debris diverter 248 can be at least generally similar in structure and function to similar devices described in detail in U.S. patent application Ser. No. 13/228,676, filed Sep. 9, 2011, and entitled "DEBRIS DIVERTER FOR COIN COUNTING MACHINE AND ASSOCIATED METHOD OF MANUFACTURE AND OPERATION;" which is incorporated herein by reference in its entirety. In other embodiments, the debris diverter 248 can be omitted. Once past the debris diverter 248, the coins 244 proceed down the coin rail 246 past a coin sensor 250. By way of example, the various coin cleaning, sensing, counting, and/or other features, components and systems associated with the coin counter 122 described herein can be at least generally similar in structure and function to one or more of the coin cleaning, sensing and counting systems described in detail in the patents and and/or patent applications listed above and incorporated herein by reference.

In the illustrated embodiment, the coins 242 that are properly discriminated as they pass by the sensor 250 are counted and deflected into a first coin passage 252*a* by a movable door 254. The counted coins 242 then flow from the first passage 252*a* into the second coin hopper 127. Conversely, coins that cannot be properly discriminated and/or are determined to be fraudulent or otherwise unwanted coins or other objects are allowed to roll into a second coin passage 252*b*. From the second coin passage 252*b* the unwanted coins 242 pass to a coin return chute 256 from which they are returned to the user at the front of the machine 100. As a result of this process, the second coin hopper 127 only receives the coins 242 that have been discriminated and counted.

Figure 3:
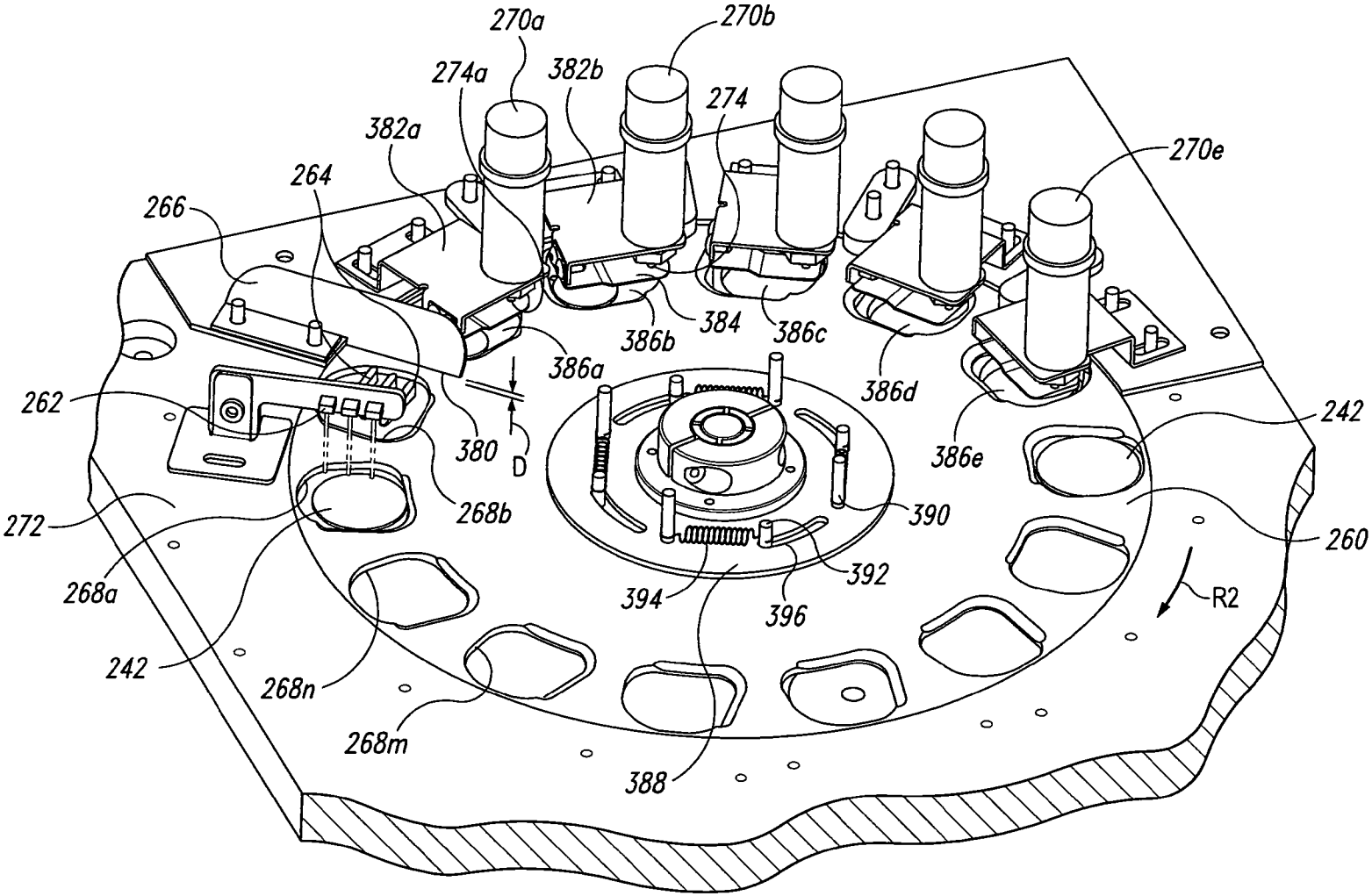
FIG. 3 is an enlarged isometric view of a coin sorting portion of the coin processing unit of FIG. 2 configured in accordance with an embodiment of the present technology.

FIG. 3 is an enlarged front isometric view of a portion of the coin sorter 124 with the second hopper 127 removed for clarity. Referring to FIGS. 2 and 3 together, the second coin disk 260 is configured to rotate in direction R2 about its central axis on a back plate 272. The back plate 272 can be manufactured from various suitable materials known in the art including, for example, high-density polyethylene (HDPE), ultra-high-molecular-weight polyethylene (UHMW) also known as high-modulus polyethylene (HMPE), etc. As described below with reference to FIG. 4, the coin disk 260 can be driven by an electric motor or other suitable drive system mounted on the opposite side of the back plate 272. The coin disk 260 includes a plurality of coin apertures or pockets 268 (identified individually as coin pockets 268*a*-268*n*) positioned around a periphery thereof. The coin pockets 268 can be generally equivalent in size, and can have rounded corners and/or other dimensional features shaped and sized to hold the coins 242 received from the second hopper 127. By way of example, the coin disk 260 can have an outer diameter ranging from about 6 inches to about 12 inches, or about 8 inches. The coin disk 260 can manufactured from various suitable metallic and non-metallic materials known in the art including, for example, stainless steel, polyurethane, Teflon, etc. In other embodiments, the coin disk 260 can have other suitable diameters and can be manufactured from other suitable materials.

In the illustrated embodiment, the coin sorter 124 further includes a coin sensor 262, a coin displacer 264, a coin deflector 266 and a series of coin movers 270 (identified individually as coin movers 270*a*-270*e*) positioned adjacent the outer periphery of the coin disk 260. The back plate 272 includes a series of coin apertures 386 (identified individually as coin apertures 386*a*-386*e*) positioned directly beneath the coin movers 270*a*-270*e* and aligned with the path of the coin pockets 268. Each of the coin apertures 386 is sized to only permit passage therethrough of a coin or coins of particular denominations. For example, in the illustrated embodiment the first coin aperture 386*a* can have an outer diameter that is only slightly larger than the diameter of a smallest desired coin, such as a U.S. dime. Similarly, the second coin aperture 386*b* can have an outer diameter that is only slightly larger than the diameter of the next-biggest desired coin, such as a U.S. penny. Likewise, the third coin aperture 386*c* can have an outer diameter that is only slightly larger than a U.S. nickel, the fourth coin aperture 386*d* can have an outer diameter that is slightly larger than a U.S. quarter, and the fifth coin aperture 386*e* can have an outer diameter that is slightly larger than U.S. 50 cent or dollar coins. The foregoing arrangement of coin apertures 386 ensures that no coin larger than a dime passes through the first coin aperture 386*a*, that no coin larger than a penny passes through the second coin aperture 386*b*, that no coin larger than a nickel passes through the third coin aperture 386*c*, and so on.

The coin pockets 268 can be shaped and sized to carry the individual coins 242 in or near a certain position in the pocket (e.g., toward an aft inner corner of the pocket) as the coins 242 move under the coin sensor 262. In the illustrated embodiment, the coin sensor 262 can include, e.g., one or more infrared sensors that detect information relating to the size (e.g., the diameter) of the coin 242 (or coins) moving through the field of the sensor 262. This information can be provided to the coin sorter controller 138 (FIG. 1B) for determining whether there is a single coin 242 in each pocket 268 or multiple coins, and if a single coin, the coin diameter. In the illustrated embodiment, the coin displacer 264 includes plurality (e.g., three) ribs or blades 265 that are normally retracted into the back plate 272. If the coin sorter controller 138 determines (based on information from the coin sensor 262) that that there are multiple coins 242 in a particular coin pocket 268, the controller 138 sends a corresponding signal to the coin displacer 264. The signal causes the coin displacer 264 to momentarily drive the blades 265 outwardly through the back plate 272 (by, e.g. a solenoid or other suitable device) when the coin pocket 268 is positioned directly over the blades 265. This knocks the jumbled coins 242 out of the coin pocket 268 and back into the second hopper 127.

In the illustrated embodiment, the coin deflector 266 is a metallic blade having an edge 380 positioned a predetermined distance D above the rotating surface of the coin disk 260. If two or more coins are knocked out of one of the coin pockets 268 by the coin displacer 264, the coins will strike the coin deflector 266 and be deflected back into the second hopper 127. Accordingly, the first coin displacer 264 and the coin deflector 266 cooperate to ensure that each of the coin pockets 268 only carries a single coin 242 over the series of coin apertures 386 in the back plate 272 during operation of the coin sorter 124.

Each of the coin movers 270 is mounted to a corresponding bracket 382 which is in turn mounted to the back plate 272. The bracket 382 can be formed from sheet metal or other suitable materials known in the art. In the illustrated embodiment, the coin movers 270 can all be the same type of electrically-actuated device (e.g. a solenoid) having a corresponding plunger or push rod 274 configured to momentarily extend outwardly therefrom beneath the bracket 382 upon actuation. In addition to the coin movers 270, a resilient deflector 384 can also be mounted to a distal portion of each bracket 382. In the illustrated embodiment, the deflectors 384 can be formed from thin, spring steel or similar material. Each deflector 384 is cantilevered outwardly from an edge of the corresponding bracket 382 so that a distal end portion of the deflector 384 is positioned beneath the corresponding coin mover 270 and directly above the adjacent coin aperture 386 in the back plate 272. When extended, the push rod 274 presses against the distal end portion of the corresponding deflector 384, thereby causing the deflector 384 to move downwardly into the adjacent coin pocket 268 and knock the coin 242 therein through the adjacent coin aperture 386 in the back plate 272.

During operation of the coin processing unit 120, the coin counter 122 discriminates and counts the coins 242 before passing them into the coin sorter hopper 127. The term "discriminate" as used herein means to determine whether the coin is a desired coin by determining or verifying, e.g., the coin denomination, authenticity, country, etc. As the coin disk 260 rotates in direction R2, the coins 242 in the hopper 127 fall into the moving coin pockets 268 and are carried upwardly past the coin sensor 262. If a single coin 242 is present in the coin pocket 268, the coin sensor 262 determines the diameter of the coin. Because only authentic and desired coins 242 are allowed to proceed into the coin hopper 127, the coin diameter is the only piece of information needed to determine the coin denomination. More specifically, since all the coins 242 in the coin hopper 127 will be, for example, authentic U.S. coins, there is no need to determine the metallic content to confirm authenticity and denomination. Instead, the coin denomination can be determined simply by knowing the coin diameter. After the coins 242 pass under the coin sensor 262, they move over the coin displacer 264, which is normally retracted into the back plate 272 to allow the coins 242 to pass. If, however, the coin sensor 262 determines that multiple coins 242 are positioned in one of the pockets 268, the coin displacer 264 strikes the coins as the pocket 268 moves past and knocks the coins out of the pocket 268. The knocked coins 242 then strike the coin deflector 266, which in turn deflects the coins back into the hopper 127. As a result of this process, only single coins 242 that are properly positioned in the pockets 268 are allowed to pass over the series of coin apertures 386 in the back plate 272.

When the coin sensor 262 determines the diameter of a particular coin 242, it sends a signal to the corresponding coin mover 270 via the coin sorter controller 138. For example, if the coin sensor 262 determines that a particular coin 242 is a U.S. dime, the controller 138 sends a signal to the first coin mover 270*a* when the dime is positioned directly over the first coin aperture 386*a* in the back plate 272. The signal causes the first coin mover 270*a* to momentarily drive the corresponding plunger 274*a* outwardly against the underlying deflector 384, which causes the deflector 384 to momentarily move into the adjacent coin pocket 368 and knock the dime through the aperture 386*a* in the black plate 272. Similarly, if the coin sensor 262 determines that a particular coin 242 is, for example, a nickel, then the coin sensor 262 sends a signal to the third coin mover 270*c* at an appropriate time for the third coin mover 270*c* to drive the corresponding plunger 274*c* against the adjacent deflector 384 and knock the nickel through the third coin aperture 386*c* in the back plate 272. In the foregoing manner, all of the coins in the coin sorter hopper 127 can be properly sorted by passing them through the appropriate coin aperture on the back plate 272.

Referring to FIG. 3, the coin disk 260 can be coupled to its drive system (not shown in FIG. 3) with a shock absorbing apparatus to prevent or at least limit damage to the coin disk 260 or related components from a sudden jam. For example, in the illustrated embodiment the coin disk 260 is mounted beneath a central hub 388. The hub 388 carries a plurality of anchors or studs 390 fixedly attached thereto, and a plurality of arcuate slots 396 positioned between the adjacent studs 390. A plurality of dowels or guide pins 392 are fixedly attached to the coin disk 260 and extend upwardly therefrom through the slots 396. The guide pins 392 enable the disk 260 to rotate back and forth relative to the hub 388 between the end portions of the slots 396. A resilient biasing member 394 (e.g., a coil spring) extends between each dowel pin 392 and the nearest stud 390 in the direction R2. During normal operation, the biasing members 394 bias the dowel pins 392 against a first end portion of the corresponding slot 396. If, however, the coin disk 260 encounters a jam or is otherwise stopped abruptly during operation, the hub 388 can continue to rotate for at least the length of the slots 396 before the hub 388 applies substantial force to the coin disk 260 and potentially causes damage. This shock absorbing feature provides a short period of time for detecting a jam in the system (with, e.g., a suitable sensor known in the art) and shutting off the drive system before damaging the coin disk 260 and/or the drive system.

Figure 4:
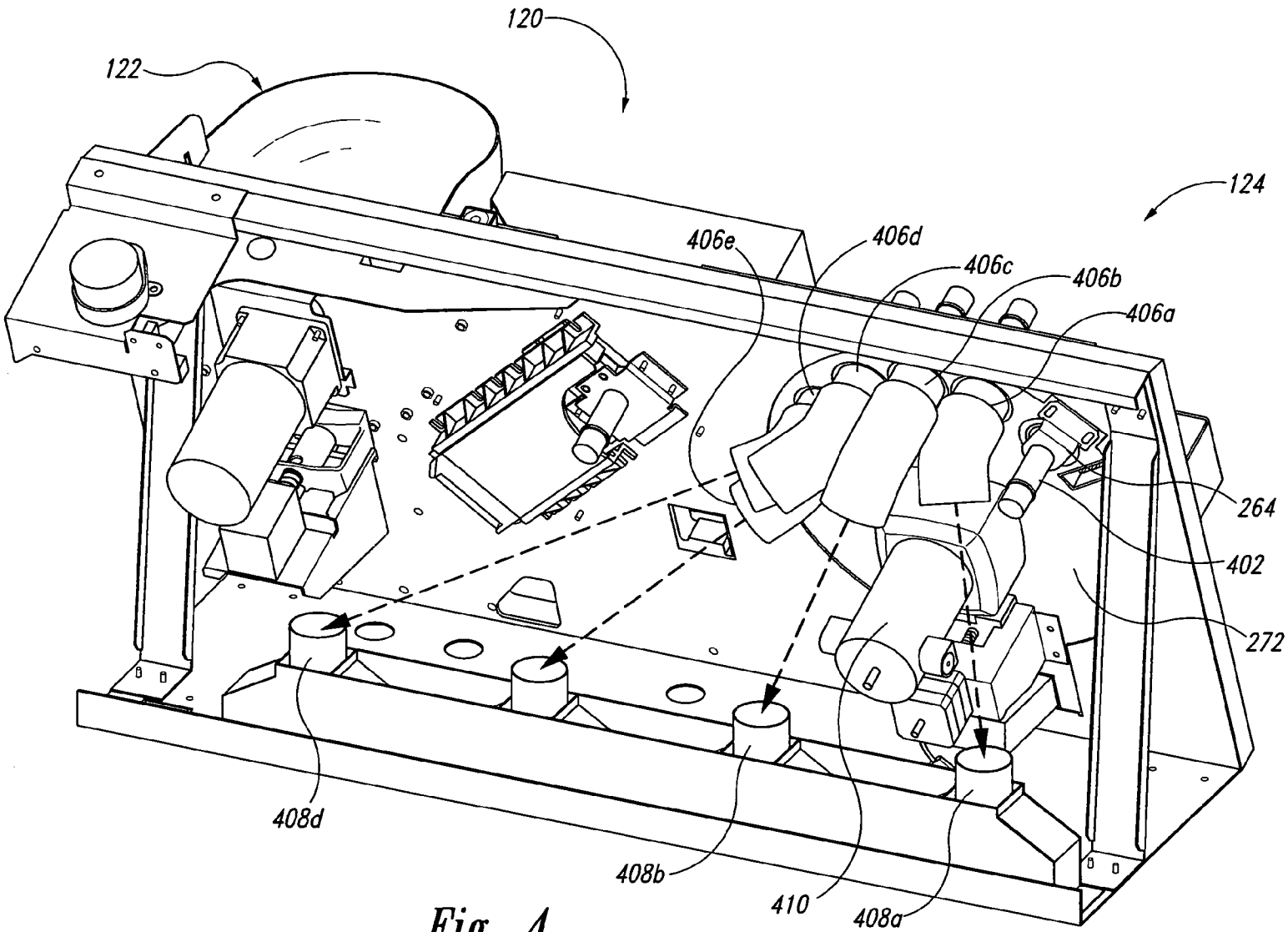
FIG. 4 is a rear isometric view of the coin processing unit of FIG. 2.

FIG. 4 is a rear isometric view of the coin processing unit 120 described above with reference to FIGS. 2 and 3. As this view illustrates, the coin displacer 264 can include an actuator 402 (e.g., a solenoid) that can be positioned to extend the blades 265 described above with reference to FIG. 3. This view also illustrates mounting of a drive system 410 (e.g., a suitable electric motor, gear system, etc.) on the back plate 272 for rotating the coin disk 260 during operation of the coin sorter 124. In addition to the foregoing features, a plurality of coin passages or tubes 406*a*-406*c* are also mounted to the backside of the back plate 272 over corresponding ones of the coin apertures 386. For example, the first coin tube 406*a* is mounted to the back plate 272 to receive coins passing through the first coin aperture 386*a*, the second coin tube 406*b* is mounted to the back plate 272 to receive coins passing through the second coin aperture 386*b*, and so on. As a result of this arrangement, only coins of a single denomination will pass through each of the individual coin tubes 406.

Although shown schematically in FIG. 4 for purposes of illustration, additional sections of tube or other types of passageways can extend from the outlet of each of the coin tubes 406 to a corresponding bin inlet 408. The bin inlets 408 can distribute the coins into the coin bins 128 described above with reference to FIG. 1A. For example, the first coin tube 406*a* can transfer coins of a first denomination (e.g., dimes) into the coin inlet 408*a*, the second tube 406*b* can similarly transfer coins of a second denomination (e.g., pennies) into the second coin inlet 408*b*, and so on. Similarly, each of the respective coin inlets 408 can include partitions and/or other structures which direct the received coins into the desired bins 128. Alternatively, as described above with reference to FIG. 1B the moveable coin feed tubes 132 and/or similar structures can also be coupled to the outlets of the coin tubes 406 to distribute the coins of specific denominations into the coin drums 130.

As those of ordinary skill in the art will appreciate, once coins have been sorted into denominations with the coin sorter 124 described in detail above, any number of structures and systems can be used to deposit the sorted coins into separate receptacles for transport and/or later use. One advantage of these embodiments is that the coins do not have to be sorted by a separate process after the counted coins have been removed from the coin processing machine 100. This can simplify the task of returning the coins to circulation.

Aspects of the invention can be embodied in a special purpose computer or data processor that is specifically programmed, configured, or constructed to perform one or more of the computer-executable instructions explained in detail herein. While aspects of the invention, such as certain functions, are described as being performed exclusively on a single device, the invention can also be practiced in distributed environments where functions or modules are shared among disparate processing devices, which are linked through a communications network, such as a Local Area Network (LAN), Wide Area Network (WAN), or the Internet. In a distributed computing environment, program modules may be located in both local and remote memory storage devices.

Aspects of the invention may be stored or distributed on tangible computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme).

References throughout the foregoing description to features, advantages, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology. Aspects of the technology can be modified, if necessary, to employ the systems, functions, and concepts of the various references described above to provide yet further implementations of the invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples: alternative implementations may employ differing values or ranges.

While the above description describes various embodiments of the invention and the best mode contemplated, regardless how detailed the above text, the invention can be practiced in many ways. Details of the system may vary considerably in its specific implementation, while still being encompassed by the present disclosure. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

I claim:

1. A coin processing machine comprising:

a coin input region configured to receive a plurality of random coins from a user;

a coin counting portion having a coin discriminator that receives the coins from the coin input region and discriminates the coins to determine a total value; and a coin sorting portion having a coin sorter that receives the coins from the coin discriminator and sorts the coins into individual denominations, the coin sorter including— a back plate having a series of coin apertures in a surface thereof, wherein each of the coin apertures is sized to permit passage therethrough of coins corresponding to a particular denomination;

a coin sensor mounted proximate the back plate;

a plurality of coin movers operably connected to the coin sensor, wherein each of the coin movers is positioned adjacent to an individual coin aperture; and a coin disk rotatably mounted relative to the back plate, the coin disk having a plurality of coin carrying portions configured to receive individual coins from the coin discriminator and carry the coins sequentially past the coin sensor and then the series of coin apertures, wherein the coin sensor is configured to send signals to the coin movers based on the denominations of the individual coins moving past the sensor, and wherein the coin movers are configured to respond to the signals by moving each of the coins through the aperture in the back plate that corresponds to the denomination of the particular coin;

wherein the coin disk is positioned between the plurality of coin movers and the back plate.

2. The coin processing machine of claim 1 wherein the coin sorting portion further includes a coin hopper that receives the coins from the coin discriminator, and wherein the coin disk receives individual coins from the coin hopper.

3. The coin processing machine of claim 1 wherein the coin disk is a first coin disk that rotates about a first axis, wherein the coin counting portion includes a second coin disk that receives coins from the coin input region and rotates about a second axis to move the coins past the coin discriminator, and wherein the first and second axes are laterally disposed at about the same elevation relative to each other.

4. The coin processing machine of claim 1, further comprising a plurality of coin bins, wherein each of the coin bins receives an individual denomination of coin from the coin sorter.

5. The coin processing machine of claim 1, further comprising:

a coin input sensor operably coupled to the coin input region; and a controller operably connected to the coin input sensor, wherein the coin input sensor is configured to sense the placement of coins in the coin input region and send a corresponding signal to the controller, and wherein the controller is configured to respond to the signal from the coin input sensor by automatically starting the coin counting portion.

6. The coin processing machine of claim 1 wherein the coin input region includes at least one coin outlet, wherein the coins received from the user move through the coin outlet toward the coin counting portion, and wherein the coin processing machine further comprises:

a coin input sensor operably coupled to the coin input region; and a controller operably connected to the coin input sensor, wherein the coin input sensor is configured to sense the placement of coins in the coin input region and send a corresponding signal to the controller, and wherein the controller is configured to respond to the signal from the coin input sensor by automatically starting the coin counting portion and allowing coins to flow through the outlet to the coin counting portion.

7. A coin processing machine comprising:

a coin input region configured to receive a plurality of random coins from a user;

a coin counting portion having— a first coin hopper that receives the plurality of coins from the coin input region; and a coin discriminator that receives the coins from the first coin hopper and discriminates the coins to determine a total value; and a coin sorting portion having— a second coin hopper that receives the coins from the coin discriminator; and a coin sorter that receives the coins from the second coin hopper and sorts the coins into individual denominations, wherein the coin sorter includes— a back plate having a series of coin apertures in a surface thereof, wherein individual coin apertures are sized to permit passage therethrough of coins corresponding to particular denominations;

a coin sensor mounted proximate the back plate;

a plurality of coin movers operably connected to the coin sensor, wherein each of the coin movers is positioned adjacent to an individual coin aperture; and a coin disk rotatably mounted relative to the back plate, the coin disk having a plurality of coin carrying portions configured to receive individual coins from the second coin hopper and carry the coins sequentially past the coin sensor and then the series of coin apertures, wherein the coin sensor is configured to send signals to the coin movers based on the denominations of the individual coins moving past the sensor, and wherein the coin movers are configured to respond to the signals by moving the individual coins through the adjacent apertures in the back plate;

wherein the coin disk is positioned between the plurality of coin movers and the back plate.

8. The coin processing machine of claim 7 wherein the coin sensor is configured to determine denominations of individual coins as the coins move past the coin sensor.

9. The coin processing machine of claim 7 wherein each of the coin movers includes a solenoid configured to respond to the signals from the coin sensor by pushing the individual coins through the adjacent apertures in the back plate.

10. A coin processing machine comprising:

a coin input region having a basin that receives a plurality of random coins from a user;

a coin counting portion having— a first coin hopper that receives the plurality of coins from the coin input region; and a coin discriminator that receives the coins from the first coin hopper and discriminates the coins to determine a total value, wherein the basin includes at least one outlet through which coins move from the basin toward the coin counting portion;

a vibration sensor operably coupled to the basin;

a controller operably connected to the vibration sensor and the coin counting portion, wherein the vibration sensor is configured to sense the vibration of coins being deposited into the basin and send a corresponding signal to the controller, and wherein the controller is configured to respond to the signal from the vibration sensor by automatically starting the coin counting portion and allowing coins to flow through the outlet to the coin counting portion; and a coin sorting portion having— a second coin hopper that receives the coins from the coin discriminator; and a coin sorter that receives the coins from the second coin hopper and sorts the coins into individual denominations.

11. A computer-controlled method of counting and sorting coins, the method comprising:

receiving a plurality of random coins from a user;

moving the coins past a first coin sensor to discriminate coin denominations and count the coins;

collecting the counted coins in a hopper irrespective of denomination;

removing the counted coins from the hopper with a rotating disk;

carrying the counted coins on the rotating disk past a second coin sensor to sense coin denominations; and individually knocking the counted coins off of the rotating disk at selected positions to automatically sort the counted coins into a plurality of containers based on coin denomination, wherein each container only holds coins of a single denomination.

12. The method of claim 11 wherein:

sensing coin denominations by the second coin sensor includes determining the diameters of the counted coins; and automatically sorting the counted coins includes automatically sorting the counted coins based only on the diameters of the counted coins.

13. A coin sorter comprising:

a back plate having a series of coin apertures in a surface thereof, wherein individual coin apertures are sized to permit passage therethrough of coins corresponding to particular denominations;

a coin sensor mounted proximate the back plate;

a plurality of coin movers operably connected to the coin sensor, wherein each of the coin movers is positioned adjacent an individual coin aperture; and a coin disk rotatably mounted relative to the back plate, the coin disk having a plurality of coin carrying portions configured to carry individual coins past the coin sensor and the series of coin apertures, wherein the coin sensor is configured to determine the denominations of the individual coins and send corresponding signals to the individual coin movers, and wherein the coin movers are configured to respond to the signals by moving the individual coins through the adjacent coin apertures in the back plate;

wherein the coin disk rotates between the back plate and the plurality of coin movers.

14. The coin sorter of claim 13 wherein each of the coin movers includes a solenoid having a plunger that pushes coins through the adjacent aperture in the back plate in response to the signals from the coin sensor.

15. The coin sorter of claim 13 wherein the coin movers are first coin movers, and wherein the coin sorter further comprises a second coin mover mounted proximate the back plate between the coin sensor and the first coin movers, wherein the second coin mover is configured to selectively knock coins off of the coin disk before the coins move to the first coin movers.

16. A consumer-operated coin counting machine comprising:

a coin input region configured to receive a plurality of random coins from a user;

a coin counting portion configured to receive the coins from the coin input region;

a vibration sensor operably coupled to the coin input region; and a controller operably connected to the vibration sensor and the coin counting portion, wherein the vibration sensor is configured to sense the vibration of coins being deposited into the coin input portion and send a corresponding signal to the controller, and wherein the controller is configured to automatically start the coin counting portion in response to receiving the signal from the vibration sensor.

17. The coin counting machine of claim 16 wherein the coin input portion includes at least one coin outlet, and wherein the controller allows coins to flow through the outlet and to the coin counting portion in response to receiving the signal from the vibration sensor.

18. The coin counting machine of claim 16, further comprising a user interface for receiving operating instructions from a user, and wherein the controller automatically starts the coin counting portion in response to receiving the signal from the vibration sensor and in the absence of any operating instructions from the user via the user interface.

19. The coin counting machine of claim 16, further comprising a coin cleaning apparatus operably disposed between the coin input portion and the coin counting portion, wherein the controller is configured to automatically start the coin cleaning apparatus in response to receiving the signal from the vibration sensor.

20. The coin counting machine of claim 16, further comprising a coin cleaning drum rotatably disposed between the coin input portion and the coin counting portion, wherein the controller is configured to automatically start rotation of the coin cleaning drum in response to receiving the signal from the vibration sensor.

* * * * *